US008505563B2

(12) United States Patent
Satoyoshi et al.

(10) Patent No.: US 8,505,563 B2
(45) Date of Patent: Aug. 13, 2013

(54) WASH-TARGET HOLDER, AND WASH-TARGET HOLDING APPARATUS, WASHING APPARATUS AND METHOD FOR WASHING WASH-TARGET USING THE SAME

(75) Inventors: Tatsuya Satoyoshi, Hong Kong (HK); Katsuro Tanabe, Hong Kong (HK)

(73) Assignee: SAE Magnetics (H.K.) Ltd., Shatin (HK)

( * ) Notice: Subject to any disclaimer, the term of this patent is extended or adjusted under 35 U.S.C. 154(b) by 1706 days.

(21) Appl. No.: 11/322,407

(22) Filed: Jan. 3, 2006

(65) Prior Publication Data

US 2006/0151001 A1 Jul. 13, 2006

(30) Foreign Application Priority Data

Jan. 13, 2005 (JP) ..... 2005-6772

(51) Int. Cl.
*B08B 3/00* (2006.01)

(52) U.S. Cl.
USPC ..... 134/201

(58) Field of Classification Search
USPC ..... 134/111, 186
See application file for complete search history.

(56) References Cited

U.S. PATENT DOCUMENTS 4,226,548 A * 10/1980 Reith ..... 401/188 R
4,409,999 A * 10/1983 Pedziwiatr ..... 134/95.2
4,814,906 A * 3/1989 Suzuki et al. ..... 360/75
5,022,419 A * 6/1991 Thompson et al. ..... 134/102.1
2002/0189638 A1 * 12/2002 Luscher et al. ..... 134/1.3
2006/0042652 A1 3/2006 Satoyoshi et al.

FOREIGN PATENT DOCUMENTS

| | | |
|---|---|---|
| JP | 62-191090 | 8/1987 |
| JP | 4-93197 | 8/1992 |
| JP | 6-103511 | 4/1994 |
| JP | 6-120202 | 4/1994 |
| JP | 6-320124 | 11/1994 |
| JP | 2000-33345 | 2/2000 |
| JP | 2003-117513 | 4/2003 |
| JP | 2003-152315 | 5/2003 |
| JP | 2003-205274 | 7/2003 |
| JP | 2004-082018 | 3/2004 |
| JP | 2004-121962 | 4/2004 |
| JP | 2006-192372 | 7/2006 |

OTHER PUBLICATIONS

Machine Translation of Kato et al. JP 06-103511, Apr. 1994.*
Machine Translation of Niiyama. JP 2003-152315, May 2003.*
English language Abstract of JP 6-103511.
English language Abstract of JP 6-120202, Apr. 28, 1994.
English language Abstract of JP 2000-33345, Feb. 2, 2000.
English language Abstract of JP 6-103511, Apr. 15, 1994.

(Continued)

*Primary Examiner* — Michael Kornakov
*Assistant Examiner* — David Cormier
(74) *Attorney, Agent, or Firm* — Greenblum & Bernstein P.L.C.

(57) ABSTRACT

It is to improve the washing efficiency of the wash-target and the cleanness of the washing. There is provided a wash-target holder that is soaked in a wash tank by holding at least one wash-target, which comprises a tray for placing the wash-target, wherein a suction hole is provided at a wash-target placing area of the tray, which is opened through the tray for sucking the wash-target from an opposite side of the wash-target placing area.

21 Claims, 14 Drawing Sheets

(56) References Cited

OTHER PUBLICATIONS

English language Abstract of JP 2003-152315, May 23, 2003.
English language Abstract of JP 2003-117513, Apr. 22, 2003.
English language Abstract of JP 2004-082018, Mar. 18, 2004.
English language Abstract of JP 2006-192372, Jul. 27, 2006.
Japan (JP2008-003770) Office action and English languge translation, mail date is Aug. 2010.
Japan (JP2005-006772) Office action and English languge translation, mail date is Aug. 2010.

* cited by examiner

WASH-TARGET HOLDER, AND WASH-TARGET HOLDING APPARATUS, WASHING APPARATUS AND METHOD FOR WASHING WASH-TARGET USING THE SAME

BACKGROUND OF THE INVENTION

1. Field of the Invention

The present invention relates to a holder and a holding apparatus for holding wash-targets when washing the wash-targets such as electronic components and fine components, and to a washing apparatus for performing washing using the same. More specifically, it relates to a holder, a holding apparatus and a washing apparatus used at the time of washing by soaking the wash-target in a washing solvent. Further, it relates to a method for washing the wash-targets.

2. Description of the Related Art

Electronic components constituted of semiconductor chips, small-size precision components, etc. are required to be highly clean depending on the purpose of their use. The components are washed after being manufactured and before being shipped as products or before being mounted into a device. Especially, a magnetic head slider is required to be highly clean for floating a magnetic disk low, since it is mounted to a magnetic disk device. Further, the magnetic head slider is a component which requires a highly precise positioning, so that it is required to be washed surely.

Patent Literature 1 discloses an example of a method for washing such components. The method disclosed in Patent Literature 1 is a method in which a magnetic head slider is soaked in a wash tank by being held to a holder and ultrasonic washing is performed in that state. The above-described holder is constituted of: through-holes formed in lattice form for enclosing the magnetic head slider; a member comprising a net for covering the bottom end openings of the through holes; and a member comprising a net for covering the upper end openings thereof. The magnetic head slider is enclosed thereby within the through-holes and it is surrounded by the wall face of the through-hole and a pair of the nets which cover both end openings of the through-holes. Thereby, the magnetic head slider is prevented from being projected outside. Further, the dimension and thickness of the opening of the through-hole is set 1.1-2.5 times the longitudinal and lateral dimensions and the thickness of the magnetic head slider, so that the magnetic head slider can freely move within the through-hole. Thereby, the ultrasonic washing can be effectively performed in the wash tank.

[Patent Literature 1] Japanese Patent Undisclosed Publication No. 6-103511

However, there is an inconvenience generated as described below when components are washed by using the holder of Patent Literature 1. First, there is a net provided to be in contact with a magnetic had device part and an ABS surface of the magnetic head slider, which are most important components and require high cleanness. Thus, the net becomes the obstacle to washing, thereby deteriorating the cleanness. Further, since the wash-target is surrounded by the wall faces, the solvent of a washing liquid cannot be easily removed from the wash-target after completing the washing. Especially, the solvent may remain in four corners (corner parts) and stains can be generated in the wash-target. Furthermore, both sides of the wash-target are held by the nets so that ESD break is likely to be generated. Moreover, the wash-target cannot be stably held by the nets so that the wash-target may move during the washing by ultrasonic oscillation and collide against the wall faces. Due to the impact, there may be a crack or break generated, thus causing damages to the wash-target.

SUMMARY OF THE INVENTION

Therefore, the present invention improves the inconveniences of the conventional case described above. Particularly, it is the object of the present invention to provide a wash-target holder, a wash-target holding apparatus, a washing apparatus and a method for washing, which can improve the washing efficiency of the wash-target and the cleanness after the washing.

The wash-target holder as one form of the present invention therefore is a wash-target holder to be soaked into a solvent within a wash tank by holding at least one wash-target. The wash-target holder comprises a tray for placing the wash-target, wherein a suction hole is provided at a wash-target placing area of the tray, which is opened through the tray for sucking the wash-target from an opposite side of the wash-target placing area.

Further, the suction hole is formed at a position and in a size to be covered by the wash-target that is placed on the tray.

In the above-described invention, the wash-target is placed on the suction hole formed on the tray to be sucked from the opposite side. Thereby, the wash-target is drawn to the tray and, by the sucking force, the wash-target is held to the tray. With this, the wash-target can be held to the tray without pressing over one face of the wash-target by a holding member. Thus, there is no holding member covering over the surface of the wash-target at the time of washing. Accordingly, the surface of the wash-target can be widely exposed to the solvent, thereby allowing improvements in the washing efficiency and the cleanness. At this time, the suction hole is covered by the wash-target so that the adsorption between the wash-target and the tray can be improved. Therefore, the wash-target can be held stably at the time of washing.

Furthermore, a surrounding member formed around the wash-target is provided on a wash-target placing face of the tray. Moreover, an opening is provided to the surrounding member for flowing in and out a solvent within the wash tank for the wash-target. At this time, if the wash-target is a magnetic head slider with a magnetic head element part, the opening is desirable to be formed at a position adjacent to the magnetic head element part of the magnetic head slider that is placed on the tray.

With this, the wash-target can be surrounded by the surrounding member. Thus, it becomes possible to suppress shift of the wash-target along the tray surface, thereby allowing more stable holding in cooperation with the above-described sucking force for drawing it to the tray. At this time, the opening is formed to the surrounding member for surrounding around the wash-target, so that the solvent is also flown in and out in the horizontal direction (X-Y direction) with respect to the wash-target placing face of the tray. The opening allows promotion of the solvent circulation for the wash-target that is surrounded by the surrounding member. Therefore, washing can be performed efficiently and the solvent can be promptly discharged from the tray when taken out from the wash tank after the washing. Accordingly, it is possible to suppress the solvent remained on the wash-target after washing and suppress generation of stains, thus achieving an improved cleanness as well. Further, in the case where the wash-target is the magnetic head slider, the solvent can be efficiently circulated since there is no surrounding member at a position adjacent to the magnetic head element part. Thus, the part requiring a high cleanness can be washed more effectively. Particularly, in the case of brush washing, the surrounding member is not much of an obstacle to washing the magnetic head element part. Therefore, it allows a more improvement in the cleanness.

Further, a through-hole opened through the tray is formed at a position other than the wash-target placing area of the tray. Thereby, the solvent flows in and out to the back face side of the tray through the through-hole at an area other than the wash-target placing area. Therefore, circulation of the solvent can be promoted and remains of the solvent after completing the washing can be suppressed.

Further, the wash-target holder comprises a plurality of suction holes formed on the tray and a supporting member for supporting the tray from an opposite-side face of a wash-target placing face, wherein a suction port is provided to the supporting member for supplying a sucking force to the plurality of suction holes formed on the tray from the supporting member side. At this time, the suction port is formed in accordance with a shape or size of the tray.

By performing suction through the suction port provided on the supporting member, a sucking force can be collectively supplied to the plurality of suction holes. Thus, it is possible to provide readiness for holding the wash-target by the sucking force and to simplify the structure. Particularly, by forming the suction port in the shape and the size in accordance with those of the tray, more uniform and appropriate sucking force can be supplied to each suction hole. Therefore, stable holding of the wash-target can be achieved.

Furthermore, in addition to the above-described structure, the wash-target holder comprises a separation-restricting member for restricting separation and fall of the wash-target from the tray, which is mounted when soaking the wash-target holder into the solvent. With this, the wash-target can be stably held to the tray at the time of soaking, and the washing performed thereafter can be performed more stably.

Further, a wash-target holding apparatus as another form of the present invention comprises the wash-target holder described above and a sucking device for performing suction from the suction hole provided on the tray that constitutes the wash-target holder. Alternatively, the wash-target holding apparatus comprises the wash-target holder described above and a sucking device for performing suction from the suction port provided on the supporting member that constitutes the wash-target holder.

Furthermore, the wash-target holding apparatus comprises a circulating device for returning a solvent in the wash tank drawn by the sucking device to the wash tank. At this time, it is desirable for the circulating device to comprise a purifying device for purifying the solvent.

Thereby, the solvent drawn by the sucking device is returned to the wash tank by the circulating device. Thus, the circulation of the solvent used for washing can be promoted and the washing efficiency can be improved. At this time, purification of the circulated solvent by the purifying device allows a constant supply of highly clean solvent. Therefore, the washing efficiency can be more improved.

Moreover, the sucking device comprises a gas intake device for sucking a gas and a liquid intake device that is capable of sucking a liquid; and a switching device is provided for switching the gas intake device and the liquid intake device in accordance with an immersion state of the wash-target holder in the wash tank. At this time, the switching device switches to the gas intake device for performing suction when the wash-target holder is not soaked in the solvent and to the liquid intake device for performing suction when the wash-target holder is soaked in the solvent.

With this, the wash-target can be held on the tray by the air suction before soaking it to the wash tank, and the wash-target can be held in the wash tank by sucking the solvent through switching to the liquid sucking device. Since the sucking device can be switched in accordance with the medium to be sucked, each sucking device can be used appropriately. Thus, the wash-target can be held by an appropriate sucking force.

Furthermore, the wash-target washing method as still another form of the present invention is a wash-target washing method for performing washing by soaking a wash-target holder with a wash-target into a solvent within a wash tank, wherein at least when performing the washing, the wash-target placed on the wash-target holder is sucked from a suction hole formed through the wash-target holder at an area where the wash-target is placed.

The wash-target is held so that it does not separate from the wash-target holder when soaking the wash-target holder into the solvent. Further, the solvent in the wash tank drawn from the suction hole is circulated to be returned to the wash tank during the washing. Furthermore, the solvent is purified during the circulation.

In addition, the wash-target holder is soaked into the solvent by changing a water level of the solvent within the wash tank before the above-described washing. Further, the wash-target holder is released from being soaked in the solvent by changing the water level of the solvent within the wash tank after the washing. At this time, the water level of the solvent within the wash tank is changed while fixing a position of the wash-target holder within the wash tank.

Moreover, the wash-target washing method according to yet another form comprises the steps of: a wash-target holding step for holding a wash-target; a soaking step for soaking the wash-target being held into a solvent within a wash tank; a washing step for washing the wash-target in the solvent; and a removing step for removing the solvent remained in the wash-target, wherein the steps from the wash-target holding step to the washing step are performed by using the wash-target holding apparatus described above. The soaking step soaks the wash-target into the solvent by changing the water level of the solvent within the wash tank. Further, the removing step for removing the solvent remained in the wash-target is performed by releasing the wash-target from being soaked in the solvent through changing the water level of the solvent within the wash tank. Further, the washing step is performed by ultrasonic washing, micro-bubble washing, or brush washing.

Furthermore, the washing apparatus as another form of the present invention comprises: a wash-target holder having a tray for placing a wash-target, wherein a suction hole is provided at a wash-target placing area of the tray, which is opened through the tray for sucking the wash-target from an opposite side of the wash-target placing area; a sucking device for performing suction from the suction hole provided on the tray; a wash tank in which a solvent for washing the wash-target is filled and the wash-target holder that holds at least one wash-target by suction of the sucking device is soaked; and a washing device for washing the wash-target within the wash tank.

Further, it is provided with a circulating device for returning the solvent within the wash tank drawn by the sucking device to the wash tank. The circulating device comprises a purifying device for purifying the solvent.

Furthermore, the sucking device comprises a gas intake device for sucking a gas and a liquid intake device that is capable of sucking a liquid; and a switching device is provided for switching the gas intake device and the liquid intake device in accordance with an immersion state of the wash-target holder in the wash tank. The switching device switches to the gas intake device for performing suction when the wash-target holder is not soaked in the wash tank and to the liquid intake device for performing suction when the wash-target holder is soaked in the wash tank.

In addition, the washing apparatus comprises a solvent water-level adjusting device for changing a water level of the solvent within the wash tank in order to alter an immersion state of the wash-target holder in the wash tank. This allows the wash-target to be immersed into the solvent or released from the immersion state by increasing and decreasing the water level of the solvent with respect to the wash-target while keeping the wash-target holder placed within the wash tank. Thus, a driving device or the like for bringing the wash-target holder in and out of the wash tank becomes unnecessary, thereby allowing simplification of the structure and an improvement in the work efficiency. Moreover, since it is unnecessary to perform work such as bringing out the wash-target holder from the wash tank at the time of switching the air suction and the liquid suction, it is possible to suppress fall of the wash-target from the holder, which is likely to occur at the time of such switching of the suction. Thereby, more stable washing can be performed.

Moreover, the washing apparatus according to still another form comprises: the wash-target holding apparatus described above for holding at least one wash-target; a wash tank in which a solvent for washing the wash-target is filled and the wash-target holder that constitutes the wash-target holding apparatus is soaked; and a washing device for washing the wash-target within the wash tank.

Further, in the above-described washing apparatus, the washing device is an ultrasonic washing device, a micro-bubble washing device, or a brush washing device.

As described above, the washing-target washing method or the washing apparatus of the above-described structures function similarly to the wash-target holder or the wash-target holding apparatus described above. Therefore, the above-described object of the present invention can be achieved.

The present invention is structured and functions as described above. With this, the wash-target can be held to the tray by the sucking force without holding one face of the wash-target from the above. Therefore, there is no holding member covering the washing face of the wash-target at the time of washing and the washing face can be widely exposed to the solvent. As a result, it is possible with the present invention to improve the washing efficiency and the cleanness, which is an excellent effect that is not of the conventional cases.

DETAILED DESCRIPTION OF THE PREFERRED EMBODIMENTS

The present invention is characterized to hold a wash-target by absorbing it to a tray. In the followings, specific structures and actions of a wash-target holder, a wash-target holding apparatus, and a washing apparatus will be described by referring to a case where a magnetic head slider mounted to a magnetic disk device is the wash-target. However, the wash-target of the present invention is not limited to the magnetic head slider but may be another electronic component or others.

First Embodiment

Figure 1:
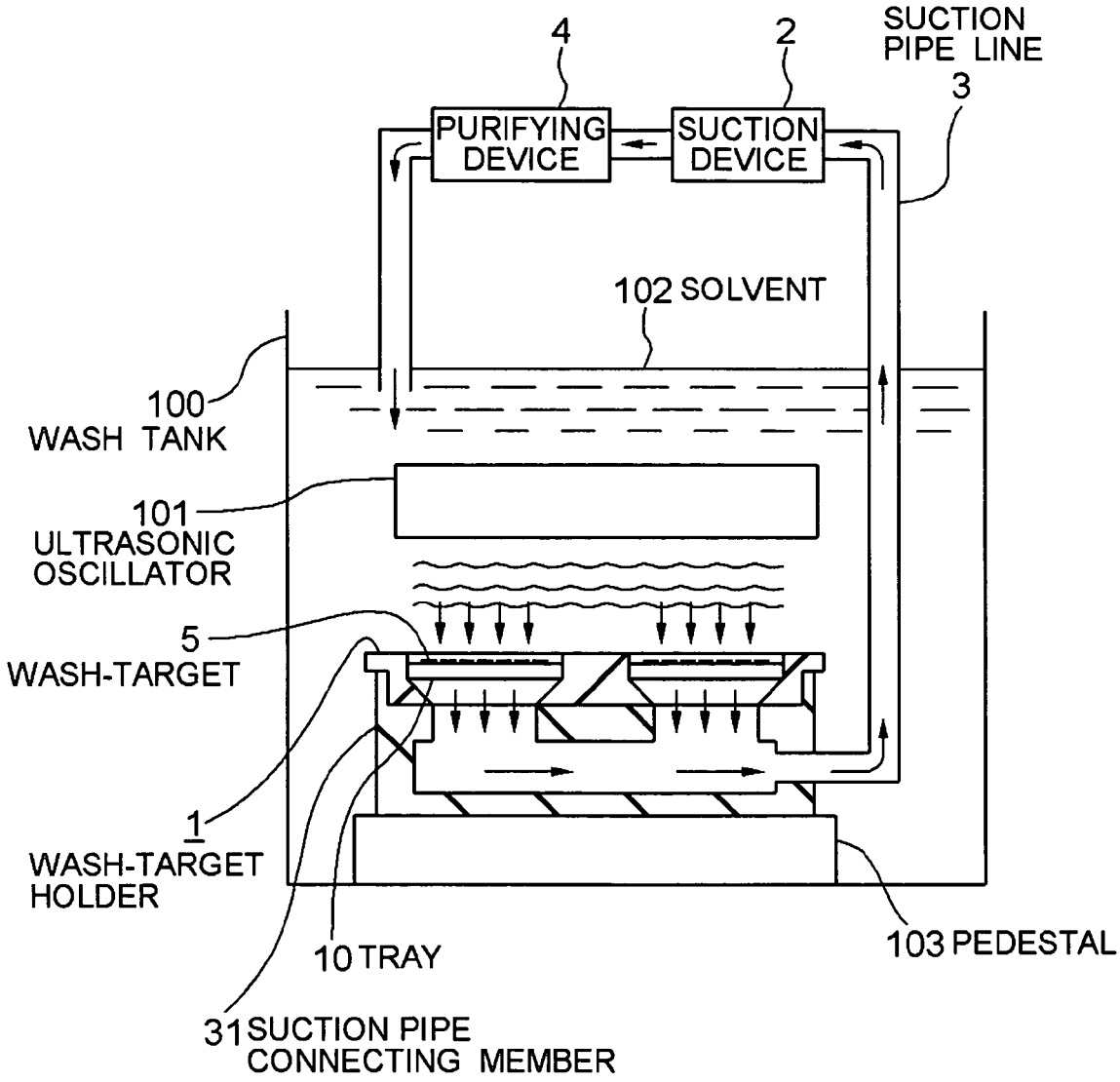
FIG. 1 is a schematic diagram for showing the structure of a washing apparatus according to a first embodiment.
Figure 2:
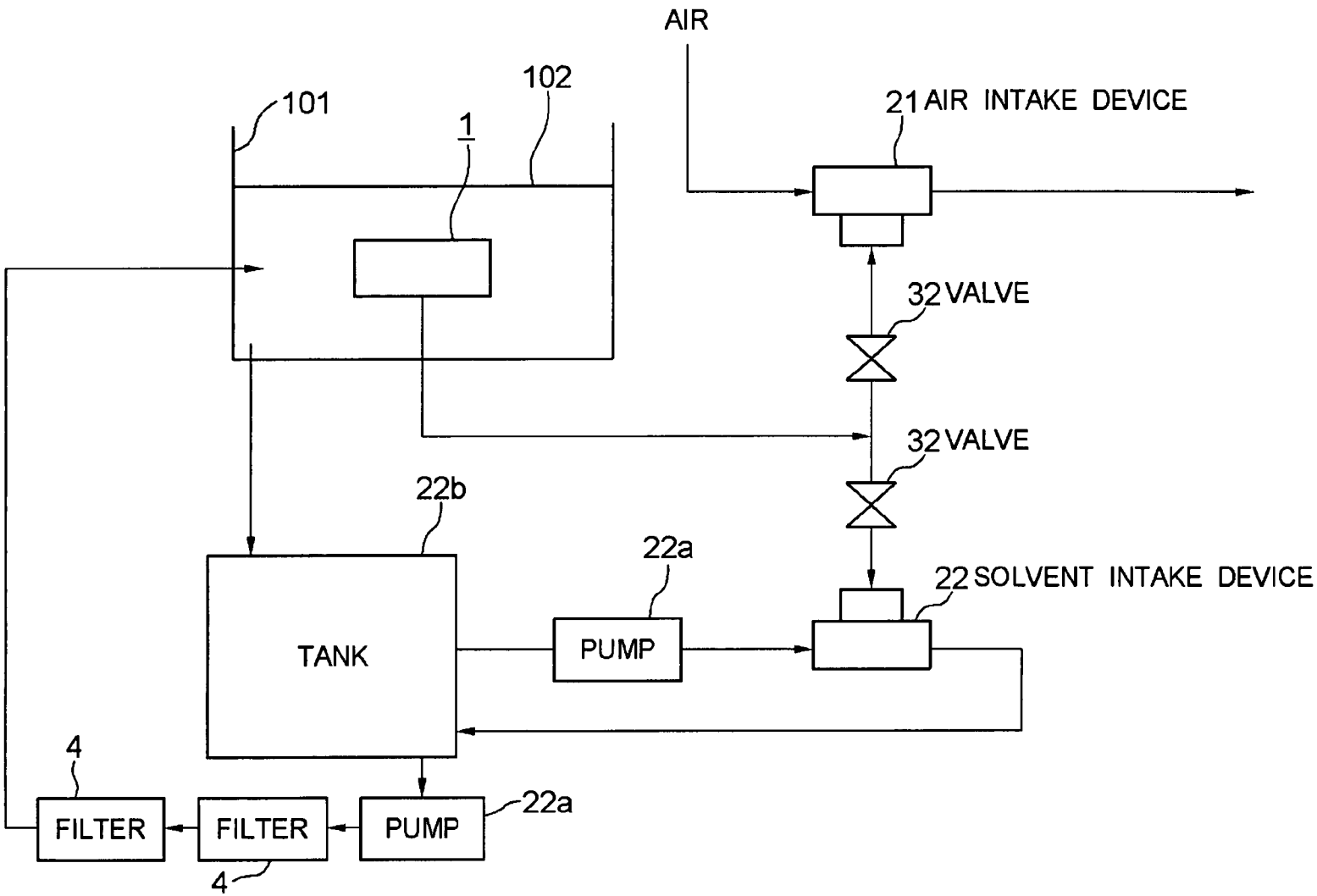
FIG. 2 is a block diagram for showing the structure of the washing apparatus.
Figure 8:
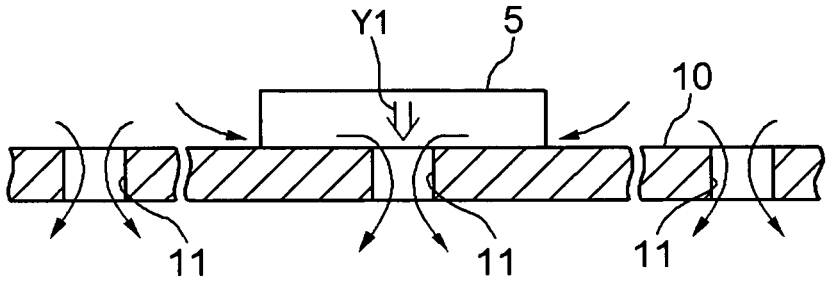
FIG. 8 is an illustration for describing the wash-target holding action.
Figure 9:
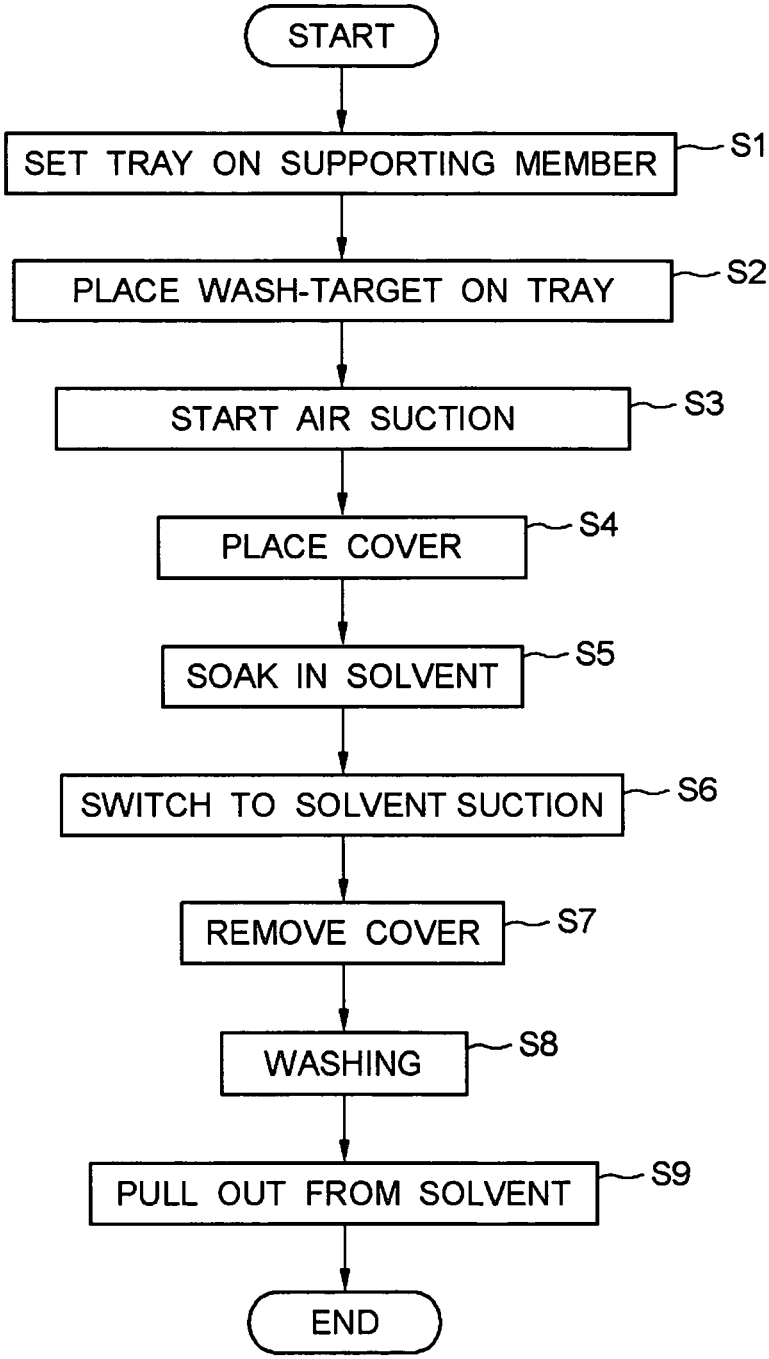
FIG. 9 is a flowchart for showing the whole action performed at the time of washing.

A first embodiment of the present invention will be described by referring to FIG. 1-FIG. 9. FIG. 1 and FIG. 2 are illustrations for showing the schematic structure of a washing apparatus for washing a wash-target. FIG. 3-FIG. 7 are illustrations for showing the structure of a wash-target holder. FIG. 8 and FIG. 9 are illustrations for showing the action of the washing apparatus.

(Structure)

Washing Apparatus

Referring to FIG. 1, the overall structure of the washing apparatus for washing a wash-target will be described. The washing apparatus comprises: a wash tank 100 to which a solvent 102 for washing a wash-target 5 is filled; wash-target holding apparatuses (1, 2, etc.) for holding a magnetic head slider 5 as the wash-target; circulators (3, 4, etc.) (circulating devices) for circulating the solvent 102; and a washing device 101 for washing the wash-target within the wash tank 100. First, the configuration thereof will be described briefly. Then, each structure will be described in detail. In FIG. 1, each structure is illustrated schematically.

Within the above-described wash tank 100, the solvent 102 is filled in a depth by which a wash-target holder 1 to be described later can be soaked in. In the solvent 102, an ultrasonic oscillator 101 (ultrasonic washing device) is provided as a washing device. The ultrasonic oscillator 101 generates ultrasonic oscillations, which achieves ultrasonic washing of the wash-target by soaking the wash-target holder 1 holding the wash-target into the solvent 102 and generating the ultrasonic oscillation. As shown in the illustration, the ultrasonic oscillator 101 is placed in the wash tank 100 at a position above the wash-target 5. For example, it is supported by a supporting member (not shown) that is mounted within the wash tank 100. The washing device is not limited to the ultrasonic oscillator 101 as will be described later but may be a micro-bubble washing device or a brush washing device (see other embodiments).

The solvent 102 filled in the wash tank 100 is made of, for example, pure water (DI), isopropyl alcohol (IPA), glycol phthalate (wax), a neutral detergent (about 0.5%).

The wash-target holding apparatus is constituted of the wash-target holder 1 which actually holds the magnetic head slider 5 as the wash-target, and a suction device 2 for supplying a sucking force for holding the magnetic head slider 5 by the wash-target holder 1.

Further, the circulators (3, 4, etc.) circulate the solvent 102 sucked by the above-described suction device 2, thereby achieving circulating action in cooperation with the suction device 2. In the followings, the circulators (3, 4, etc.) therefore will be described together in the description of the suction device 2. Each structure will be described in detail hereinafter.

(Suction Device)

The suction device 2 is connected to the wash-target holder 1 to be described later for supplying a sucking force. Specifically, the suction device 2 is provided on a suction pipe line 3 as a circulation device. By connecting a suction pipe connecting member 31 formed at one end of the suction pipe line 3 to the wash-target holder 1, the suction device 2 can supply a sucking force to the wash-target holder 1. In FIG. 1, the suction pipe connecting member 31 is illustrated as being integrally connected to the bottom face side of the wash-target holder 1. However, it may be formed in a tubular form to be connected to a suction port 16*b* that is formed in the wash-target holder 1 to be described later (see FIG. 5B). Further, the other end of the suction pipe line 3 is guided into the wash tank 100 for circulating the solvent 102 within the wash tank 100 by action of the above-described suction device 2.

Furthermore, on the suction pipe line 3, there is provided a purifying device 4 as a filter for purifying the solvent 102 flowing the suction pipe line 3. This allows purification of the solvent 2 that is contaminated from washing, so that the purified solvent 102 can be returned again to the wash tank 100.

Now, the suction device 2 will be described in more detail by referring to the block diagram of FIG. 2. In FIG. 2, each line with an arrow illustrates the suction pipe line 3. As shown in this diagram, the suction device 2 is constituted of an air intake device 21 for sucking air (gas), and a solvent intake device 22 with a capacity of sucking the solvent 102 (liquid). The intake devices 21 and 22 are both connected to the wash-target holder 1, and it is possible to switch the connection either to the intake device 21 or to the intake device 22 through a valve 32 arranged on the suction pipe line 3. Specifically, as will be described later, switching is carried out in accordance with the immersion state of the wash-target holder 1 in the wash tank 100. That is, the valve 32 is switched to use the air intake device 21 for suction when the wash-target holder 1 is not soaked in the wash tank 100, and the valve 32 is switched to use the solvent intake device 22 for suction when the wash-target holder 1 is soaked in the wash tank 100. Thus, the valve 32 functions as a switching device for switching each of the intake devices 21 and 22. This switching action may be performed manually or by controlling the valve 32 using a controller (not shown) which controls the immersion state of the wash-target holder 1.

Each of the above-described intake devices 21 and 22 will be described in more detail. First, the air intake device 21 sucks the air as described above and, by the sucking force, holds the magnetic head slider 5 as the wash-target by adsorbing it to a tray 10 as the wash-target holder 1. Therefore, it is effectively used for holding the target before soaked into the wash tank 100. The suction via the wash-target holder 1 may not be sufficient for sucking the amount of air for enabling a normal action. Thus, it is formed to allow additional suction of air (see FIG. 2). Further, the air intake device 22 sucks the solvent 102 as described above and, by the sucking force, holds the magnetic head slider 5 by adsorbing it to the tray 10. Thus, it sucks the solvent 102 for holding the magnetic head slider 5 after soaking the target in the wash tank 100. As described above, the use of the intake devices 21 and 22 of appropriate sucking capacities in accordance with a medium to be sucked allows supply of an appropriate sucking force to the wash-target holder 1. Therefore, stable holding of the wash-target 5 can be achieved. The holding action of the wash-target 5 will be described later.

Further, a pump 22*a* and a tank 22*b* are connected to the above-described solvent intake device 22. This structure is employed (see FIG. 2, not shown in FIG. 1) to draw the solvent 102 into the tank 22*b* from the wash tank 100 additionally for sucking and circulating the solvent 102 within the tank 22*b*, since the suction via the wash-target holder 1 may not be sufficient for sucking the amount of liquid for enabling a normal action.

Furthermore, as described above, there are filters 4 (purifying devices) for purifying the solvent 102 mounted on the suction pipe line 3 that is connected to the solvent intake device 22. In FIG. 2, there are two filters 4 being mounted, however, any number of filters may be provided. With this, the solvent 102 used for washing and contaminated therefore passes through the filters 4 so that washing can be carried out always by the clean solvent 102.

In the above, there has been described a case where two intake devices 21, 22 are mounted as the suction device 2, and the two are alternately used. However, a single suction device may be used. In that case, however, the suction device needs to have at least a sufficient sucking force for achieving suction of the solvent 102 while the target is soaked in the wash tank 100 so as to adsorb the magnetic head slider 5 to the tray 10 as will be described alter.

(Wash-Target Holder)

Next, the wash-target holder 1 will be described in detail. The wash-target holder 1 is a holder which holds the magnetic head slider 5 as the wash-target and is soaked in the solvent 102 within the wash tank 100. The wash-target holder 1 is constituted of the tray 10 for placing the magnetic head slider 5 and a supporting member 15 for supporting the tray 10 (see FIG. 3).

The above-described suction pipe connecting member 31 is connected to the wash-target holder 1, which is placed on a pedestal 103 disposed in the bottom face of the wash tank 100 so as to be soaked in the wash tank 100 as shown in FIG. 1. FIG. 1 schematically illustrates the cross section of the wash-target holder 1 as well as the cross section of the suction pipe connecting member 31 that is connected to the wash-target holder 1. In the followings, the tray 10 and the supporting member 15 constituting the wash-target holder 1 will be described in detail.

Figure 3:
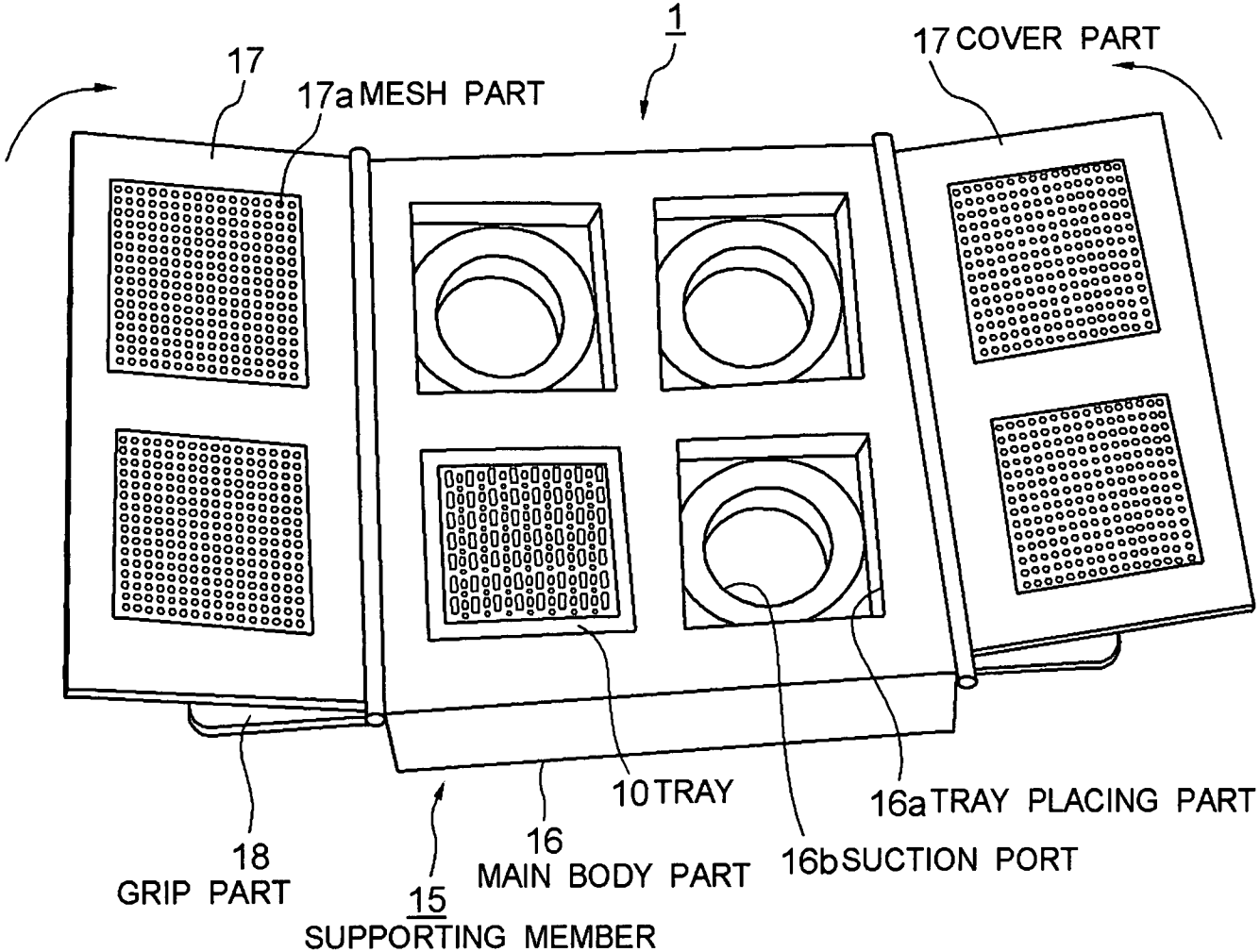
FIG. 3 is an illustration for showing the structure of a wash-target holder viewed from the top.
Figure 4:
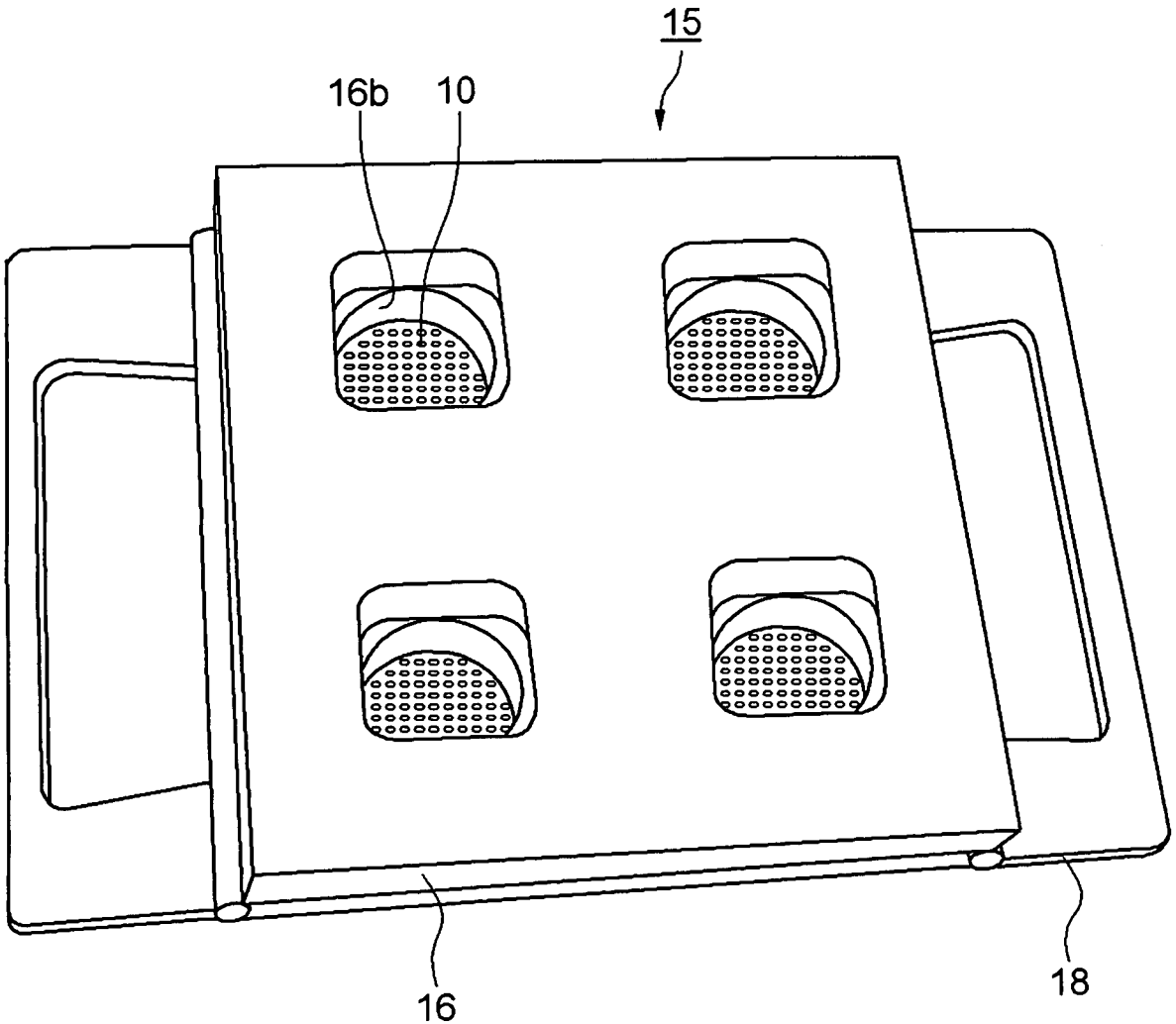
FIG. 4 is an illustration for showing the structure of the wash-target holder viewed from the bottom.

First, the supporting member 15 will be described in detail by referring to FIG. 3-FIG. 5. FIG. 3 is an illustration of the supporting member 15 viewed from the top face side (the side on which the tray 10 is placed as will be described later), and FIG. 4 is an illustration viewed from the back face side. FIG. 5 is a fragmentary sectional view of FIG. 3.

As shown in FIG. 3, the supporting member 15 is constituted of: a roughly square-shape thick main body part 16; a cover part 17 for covering the surface of the main body part 16; and grip parts 18 for grasping the supporting member 15 itself.

Figure 5A:
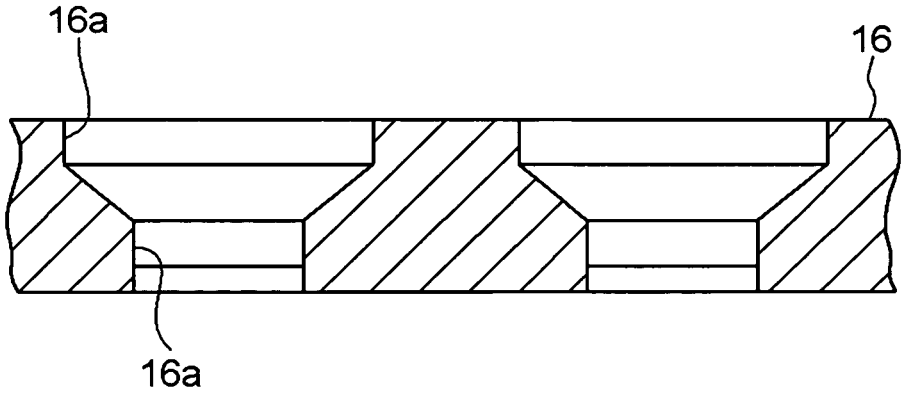
FIG. 5A is a fragmentary sectional view of the wash-target holder shown in FIG. 3.

There are four tray placing parts 16*a* for placing the tray 10, which are formed by roughly square concave parts by corresponding to the form of the tray 10. In roughly the center of the inner bottom face of the tray placing part 16*a*, a circular suction port 16*b* that goes through the back face side is formed. As shown in FIG. 5A which illustrates the cross section of this part, the suction port 16*b* is in an inverted conic shape in which the diameter gradually decreases from the inner bottom face of the concave tray placing part 16*a* towards the back face side till the midway. It becomes roughly a cylindrical shape as approaching towards the back face and becomes roughly a quadrilateral shape in the vicinity of the end of the back face (see FIG. 4).

Furthermore, on a pair of side faces of the main body part 16, the cover part 17 is provided, respectively, which is supported to cover the surface of the main body part 16 to be opened and closed freely. The cover part 17 is provided with a mesh part 17*a* for covering the surface of the tray 10 that is disposed on the tray placing part 16*a* when the cover part 17 is closed. There are a great number of holes formed in the mesh part 17*a*. As will be described later, the cover part 17 is placed over only when being soaked in the solvent 102. When used for covering, the cover part 17 exhibits an effect of a separation restricting member for restricting the separation of the wash-target from the tray 10 by a buoyant force and the like working on the magnetic slider 5 placed on the tray 10. The cover part 17 is opened at the time of washing so that it does not cover the tray 10.

Further, there is provided, respectively, the grip part 18 protruding from the side face on a pair of side faces of the main body part 16 under the cover part 17. These are grasped when carrying the supporting member 15 or used for support when being placed in the wash tank 100.

Figure 5B:
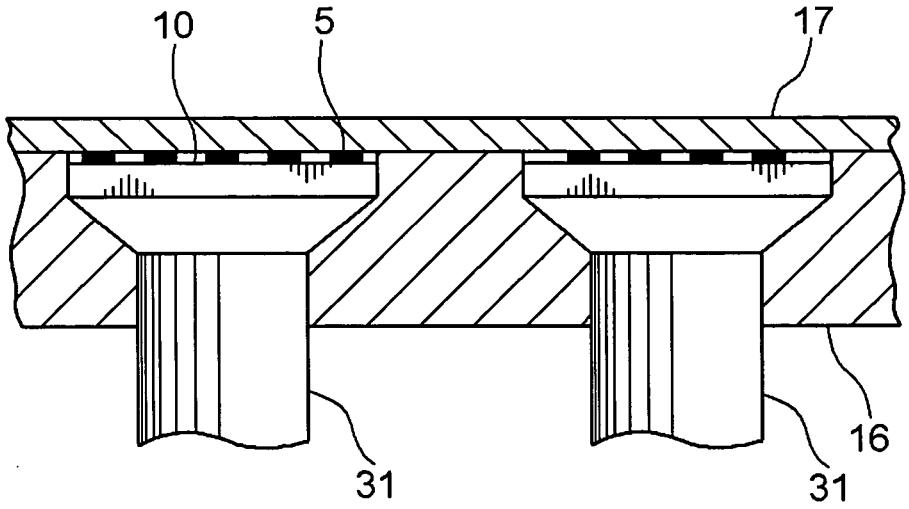
FIG. 5B is a cross section for showing the state where a tray and a suction pipe connecting member are provided.

FIG. 3 illustrates the state where the tray 10 is disposed on the tray placing part 16*a* positioned at the lower left. Meanwhile, FIG. 5B illustrates the state where the tray 10 is disposed on both tray placing parts 16*a* in the cross sectional view of FIG. 3, and the suction pipe connecting member 31 of the suction pipe line 3 is connected to the suction port 16*b*. Unlike the shape shown in FIG. 1, FIG. 5B illustrate the suction pipe connecting member 31 that is formed in a tubular shape so as to be directly fitted to the upper part of the cylindrical form of the suction port 16*b*.

By forming the wash-target holder 1 in this manner and connecting the suction pipe line 3 thereto, suction is performed from the back face side of the tray 10 where the magnetic head slider 5 is not placed. FIG. 5B illustrates the state where the cover part 17 is placed over. However, it is used only when being soaked into the wash tank 100 and it is taken off for washing.

In the above, there has been described by referring to a case where the suction port 16*b* connected to the suction pipe connecting member 31 is in a circular shape. However, it is merely an example and not to be limited to that shape. For example, the suction port 16*b* may be molded in a quadrilateral shape by corresponding to the shape and size of the tray 10. In that case, the suction pipe connecting member 31 is also molded in accordance with the form of the suction port 16*b*. Further, the suction port 16*b* may be formed in the size of the tray 10 so that the entire surface of the tray 10 can be adsorbed. This allows a uniform supply of sucking force over the entire surface of the tray 10, thereby improving the efficiency for holding the wash-target 5.

Figure 6:
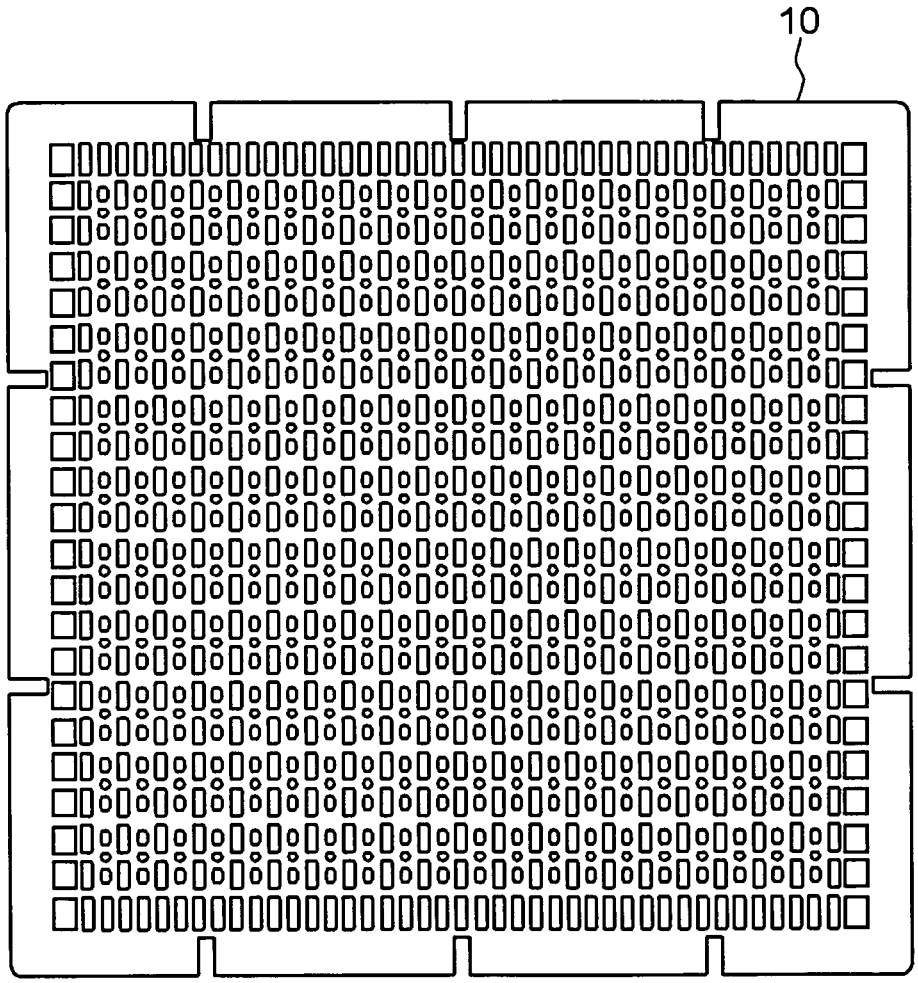
FIG. 6 is a plane view for showing the structure of the tray.

Next, the form of the tray 10 will be described in detail by referring to FIG. 6 and FIG. 7. FIG. 6 is an illustration showing the overall form of the tray, and FIG. 7A and FIG. 7B are fragmentary enlarged views showing the form of the tray in detail.

First, as shown in FIG. 6, the tray 10 in roughly a square shape is formed with a single plate-type member with a prescribed thickness. The size thereof is substantially the same as that of the tray placing part 16*a* formed on the surface of the main body part 16 of the above-described supporting member 15. On one face of the tray 10, there are formed a number of protrusions 12, 13 (surrounding members) and a through-hole 11, constituting a wash-target placing face for disposing the magnetic head slider 5. The structure of the wash-target placing face will be described by referring to FIG. 7.

Figure 7A:
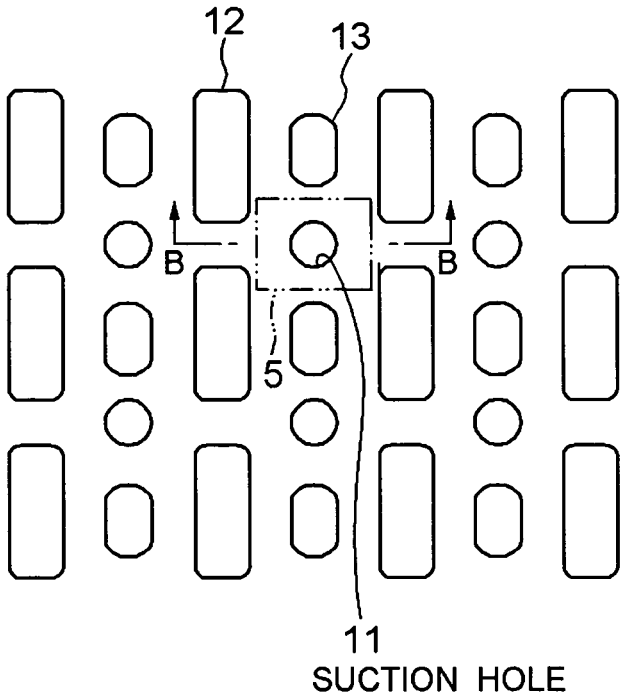
FIG. 7A is a fragmentary enlarged view of the tray.

FIG. 7A is a fragmentary enlarged view of the wash-target placing face of the tray 10. FIG. 7B is a cross section taken along the line B-B of FIG. 7A. The structure shown in FIG. 7A is formed almost uniformly on the entire surface of the tray 10.

More specifically, the above-described through-hole 11 formed on the tray 10 is a suction hole 11 for sucking the magnetic head slider 5 from the opposite side of the placing area where the magnetic head slider is disposed. The suction hole 11 is formed at a placing position of the magnetic head slider 5 in a size smaller than the placing area of the magnetic head slider 5. In other words, the suction hole 11 is formed in a size to be covered by the magnetic head slider 5 almost at a center of the region surrounded by each of the protrusions 12 and 13.

Further, there are two kinds in the protrusions 12 and 13, e.g. the protrusion 12 in roughly a rectangular shape and the protrusion 13 in roughly an oval shape. The roughly rectangular protrusions 12 are arranged in line in the vertical direction of FIG. 7A with a little space in between, and a plurality of the columns are provided in the horizontal direction of FIG. 7A at the interval that is almost the same as the long side of the magnetic head slider 5 in roughly a rectangular shape (strictly, at an interval longer than the long side). Further, between the rows, the roughly oval protrusions 13 are formed in line in the same manner (vertical direction of FIG. 7A). The interval of the protrusions 13 on the same column in the vertical direction is almost the same as the short side of the magnetic head slider 5 (actually, longer than the short side), and the protrusions 13 are formed by the same arranging pattern as that of the roughly rectangular protrusions 12. Furthermore, the above-described suction holes 11 are formed between the roughly oval protrusions 13 which constitute the column.

As shown in FIG. 7A, this allows a formation capable of placing the magnetic head slider 5 as the wash-target over the suction hole 11 between each of the protrusions 12 and 13. That is, both short sides of the quadrilateral magnetic head slider 5 are surrounded by four roughly rectangular protrusions 12, while both long sides are surrounded by the roughly oval protrusions 13, respectively. Therefore, each of the protrusions 12 and 13 enables restriction of the shift of the magnetic head slider 5 along the tray surface.

Figure 7B:
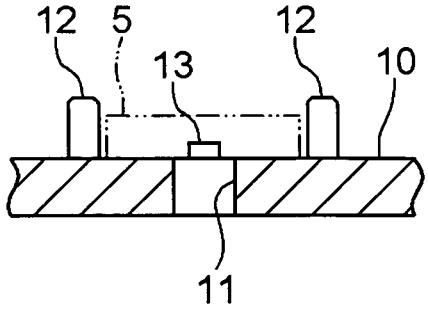
FIG. 7B is a cross section taken along the line B-B of FIG. 7A.

In FIG. 7B, the roughly rectangular protrusion 12 is illustrated to be formed higher than the thickness of the magnetic head slider 5. However, it is not limited to this height. Further, the height of the roughly oval protrusion 13 is not limited to the height shown in FIG. 7B either.

Furthermore, since each of the protrusions 12 and 13 is arranged at prescribed intervals, thus providing the state where there are openings formed on the periphery of the magnetic head slider 5 placed on the tray 10. That is, with the arrangements of the protrusions 12 and 13 on the tray 10 shown in FIG. 7A, the center part in the short side of the magnetic head slider 5 and the part of the long side other than the center part are exposed to the solvent 102 at the time of washing. Thus, as will be described later, it is possible to flow in and out the solvent in the horizontal direction (X-Y direction) with respect to the wash-target placing face of the tray 10. Therefore, circulation of the solvent 102 for the magnetic head slider 5 can be promoted. Moreover, when taken out from the wash tank 100, the solvent can be promptly discharged form the tray 10 since the side faces of the slider 5 are exposed.

On the tray 10 shown in FIG. 7A, there is formed only the suction hole 11 for holding the wash-target, i.e. the through-hole formed at the wash-target placing part. However, other through-holes may be formed. In the followings, the through-hole 11 at an area where the magnetic head slider 5 is not placed will be described as another through-hole.

The tray 10 is formed of a mixed resin of a Peek resin (polyarylene ether ketone based resin) and carbon for dealing with ESD matter. However, this material is merely an example and not to be limited to this. For example, it is possible to use a thermoplastic resin having ESD resistance and solvent resistance.

(Holding Action)

Next, by referring to FIG. 8, there is described the action of the above-described wash-target holding apparatuses (1, 2, etc.) for holding the magnetic head slider 5 as the wash-target at the time of washing. Like FIG. 7A, FIG. 8 illustrates the case where the magnetic had slider 5 is disposed at a prescribed area on the tray 10. There is no supporting member 15 for supporting the tray 10, the suction device 2 and the like shown in this illustration. However, it is considered that those components as in FIG. 1 and other illustrations are provided as well. Further, although not shown, each of the protrusions 12 and 13 on the tray 10 are provided naturally. There is described the state of holding the wash-target 5 when the wash-target holder 1 is soaked into the wash tank 10. The holding action in the air before being soaked is the same except that the medium to be sucked is air.

As shown in FIG. 8, the magnetic head slider 5 is disposed on the tray 10 and, in that state, suction by the suction device 2 is started from the back face side of the tray 10. Upon this, the solvent 102 placed on the wash-target placing face of the tray 10 goes through the suction hole 11 and flows onto the back face side. At this time, in the area where the magnetic head slider 5 is disposed, the solvent 102 passes through the slight gap between the magnetic head slider 5 and the tray 10 and is guided to the suction hole 11, thereby supplying a sucking force to the magnetic head slider 5 (see an arrow Y1). When the magnetic head slider 5 is closely fitted to the tray 10, the solvent 102 does not passes through the suction hole 11. However, even in that case, the magnetic head slider 5 is sucked from the back face side of the suction hole 11 (see the arrow Y1). Thus, there is a sucking force supplied to the magnetic head slider 5 so that it is adsorbed to the tray 10. Therefore, the magnetic head slider 5 can be held to the tray 10 without holding the surface (the surface on the opposite side to the tray 10) by some kind of a holding member. As a result, the washing face can be exposed widely to the solvent 102 at the time of washing so that the washing efficiency and the cleanness can be improved.

At this time, as shown in FIG. 1 and FIG. 5, suction is performed by connecting the suction pipe connecting member 31 to the suction port 16*b* that is formed on the supporting member 15 for supporting the tray 10. Thus, it is possible to suck the entire surface of the tray 10 efficiently and a plurality of the wash-targets 5 can be held easily. As shown in the left and right sides of FIG. 8, there is a sucking force applied to the suction holes 11 on which the magnetic head slider 5 is not disposed. The solvent 102 freely flows through the suction holes 11 from the top face side towards the back face side so that circulation of the solvent 102 within the wash tank 100 can be promoted.

(Washing Action)

Next, by referring to FIG. 9, the whole washing action performed by the above-described washing apparatus will be described. The circulation state of the solvent 102 will be described by referring particularly to FIG. 1 and FIG. 2 although other illustrations are referred to as well.

First, there is described an action for holding a wash-target by the wash-target holder 1 (a wash-target holding step). As shown in FIG. 3, the tray 10 is disposed on the tray placing part 16*a* of the supporting member 15 (step S1), and the magnetic head slider 5 as the wash-target is disposed on the tray 10 (step S2). Then, the suction pipe connecting member 31 is connected to the suction port 16*b* of the supporting member 15 for connecting the wash-target holder 1 to a circulation system that uses the suction device 2. Subsequently, suction of air is started using the air intake device 21 (step S3). Thereby, a sucking force is supplied to each suction hole 11 of the tray 10 so that, as shown in FIG. 8, the magnetic head slider 5 is held to the tray 10 by the suction.

Subsequently, the wash-target holder 1 to which the magnetic head slider 5 is disposed is soaked into the solvent 102 in the wash tank 100 (a soaking step). At this time, the cover part 17 is placed thereon (step S4) so that the magnetic head slider 5 on the tray 10 does not separate from the tray 10 against the sucking force due to the buoyant force. In that state, the wash-target holder 1 is soaked into the solvent 102 (step S5).

Then, in the solvent 102, the suction device is switched to the solvent intake device 22 (step S6). That is, the air suction is switched to solvent suction by controlling open/close of each valve 32 on the suction pipe lines 3. Upon this, the solvent 102 is drawn from the suction port 16*b* of the wash-target holder 1. Thus, as shown in FIG. 8, a sucking force is supplied to the suction holes 11 of the tray 10 so that the magnetic head slider 5 can be held continuously by the suction. At this time, as shown by an arrow of FIG. 1, the solvent flows to pass through the suction holes 11 from the wash-target placing face side of the wash-target holder 1 towards the back face side and flows into the suction pipe line 3.

Subsequently, while continuing the above-described solvent suction, the cover part 17 is opened and removed from the magnetic head slider 5 (step S7). Then, in that state, the ultrasonic oscillator 101 is disposed above the magnetic head slider 5 in the solvent 102 for performing the ultrasonic washing (step S8). At this time, there is a sucking force applied by the solvent suction so that the magnetic head slider 5 is held to the tray 10 (see FIG. 8). Since there is no member for covering the washing face of the magnetic head slider 5 (the opposite side of the face that faces the tray 10), it is exposed to the solvent 102. Therefore, washing by ultrasonic can be effectively performed and the cleanness can be improved. Particularly, it is possible to perform washing that is more effective by placing the magnetic head slider 5 in such a manner that the floating surface, which has the magnetic head element part formed thereon and requires washing of high precision, faces the opposite side to the tray 10.

During the above-described washing, although it is a small amount, the solvent 102 flows in from the periphery to the face (contact face) of the magnetic head slider 5 facing the tray 10, i.e. gap between the magnetic head slider 5 and the tray 10 (see FIG. 8). Therefore, it is possible to wash the surface of the magnetic head slider 5 facing the tray 10. Further, the areas between each of protrusions 12 and 13 provided around the magnetic head slider 5 are open, thereby allowing flow of the solvent 102 around the magnetic head slider 5 as well. Thus, the peripheral faces can be washed. Furthermore, a sucking force is applied also to other suction holes 11 on the tray 10 where the magnetic head slider 5 is not disposed. Thereby, flow of the solvent 102 as described above can be promoted (see FIG. 8).

Furthermore, at the time of washing, the solvent 102 drawn by the wash-target holder 1 passes through the purifying device 4 via the suction pipe line 3 and returns to the wash tank 100 (see an arrow of FIG. 1). The solvent 102 that is contaminated from washing is purified and reutilized so that the washing efficiency can be more improved.

After the washing, the wash-target holder 1 is taken out from the wash tank 100 (step S9), and the solvent 102 is removed from the magnetic head slider 5. At this time, the solvent 102 on the tray 10 is discharged from the suction holes 11 and between each of the protrusions 12 and 13 of the tray 10. Thus, the solvent 102 can be promptly removed. Therefore, it is possible to suppress remains of the solvent on the wash-target after washing and suppress generation of satins and the like. Thus, an improvement in the cleanness can be achieved as well.

Second Embodiment

Figure 10:
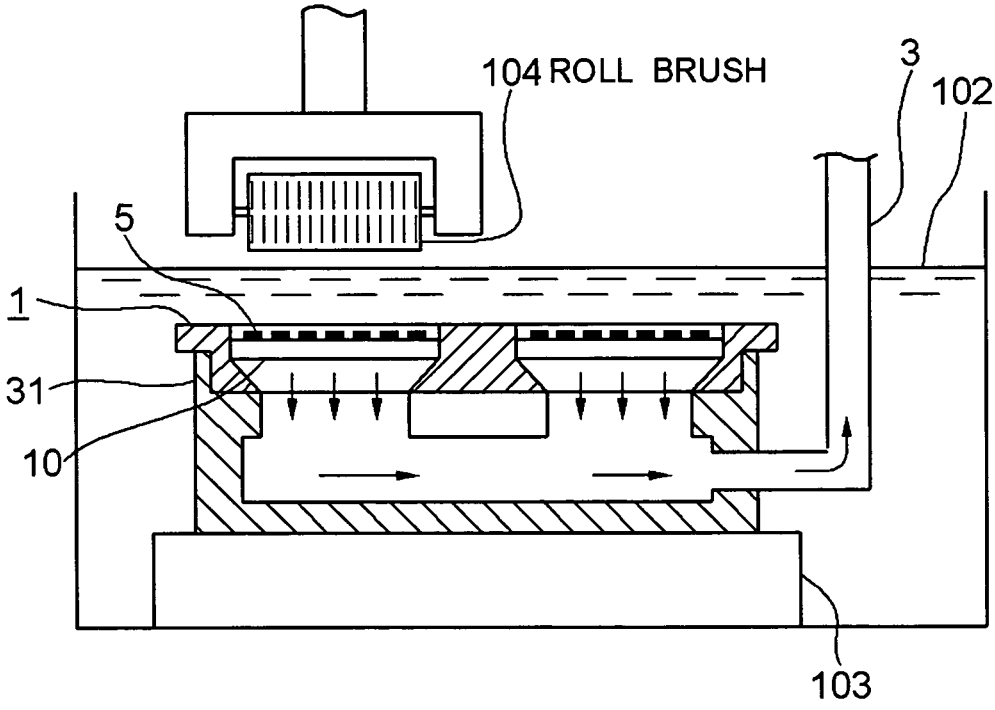
FIG. 10 is a schematic diagram for showing the structure of a washing apparatus according to a second embodiment.
Figure 11:
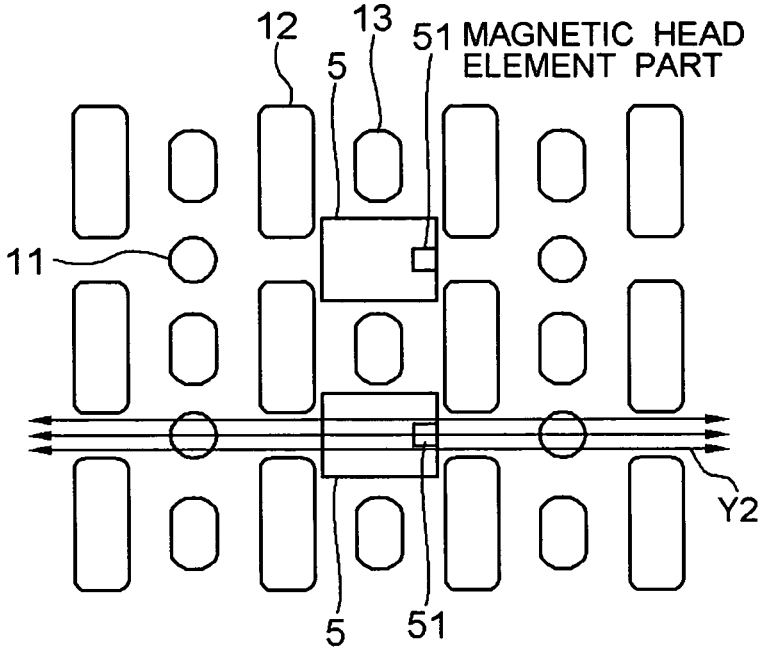
FIG. 11 is a fragmentary enlarged view of a tray according to the second embodiment.

Next, a second embodiment of the present invention will be described by referring to FIG. 10 and FIG. 11. FIG. 10 is a schematic diagram for showing the structure of the washing apparatus according to this embodiment, and FIG. 11 is an illustration for showing the structure of the tray.

The washing apparatus of this embodiment uses a roll brush 104 (a brush washing device) as a washing device, which washes the magnetic head slider 5 as the wash-target disposed on the tray 10 by brushing it using the roll brush 104. In other words, the washing apparatus of this embodiment comprises the structure similar to that of the washing apparatus disclosed in the first embodiment but with the roll brush 104 as the washing equipment instead of the ultrasonic oscillator 101.

Specifically, as shown in FIG. 10 which illustrates the washing apparatus schematically, the wash-target holder 1 to which the suction pipe connecting member 31 of the suction pipe line 3 is connected is placed on the pedestal 103 that is disposed in the wash tank 100. The solvent 102 is filled in the wash tank 100 up to the height by which the top part of the magnetic head slider 5 held to the wash-target holder 1 can be soaked. Still above, there is provided the roll brush 104. Further, the roll brush 104 is provided with a driving device such as a motor for rotating the brush part and a moving device for shifting the position of the roll brush 104. Thereby, the roll brush 104 rotates and shifts at the position where the tip of the brush comes in contact with the surface of the wash-target holder 1, and performs washing by brushing along one direction.

Next, the tray 10 according to the embodiment will be described by referring to FIG. 11. As shown in this illustration, the form of the tray 10 is almost the same as that of the first embodiment described above. However, specifically, it is formed in such a manner that each of the above-described protrusions 12 and 13 do not come adjacent to the magnetic head element part 51 of the magnetic head slider 5 that is to be disposed. In other words, as shown by arrows Y2, it is so set that the roll brush 104 brushes through between the roughly rectangular protrusions 12 at the time of washing. Thus, the tray 10 is formed in such a manner that allows placement of the magnetic head slider 5 so that the magnetic head element part 51 lies on the brushing paths (Y2).

With this, obstruction by the protrusions 12 and 13 to brush washing can be suppressed. Therefore, by locating the part that requires specifically high cleanness at the passing area of the brush, it can be effectively washed.

The brushing paths are not limited to those shown in the illustration but other paths may be employed. The tray 10 may be formed with such an arrangement of the protrusions 12 and 13, which is capable of disposing the magnetic head slider 5 so that the magnetic head element part 51 lies at a position on the paths.

Third Embodiment

Figure 12:
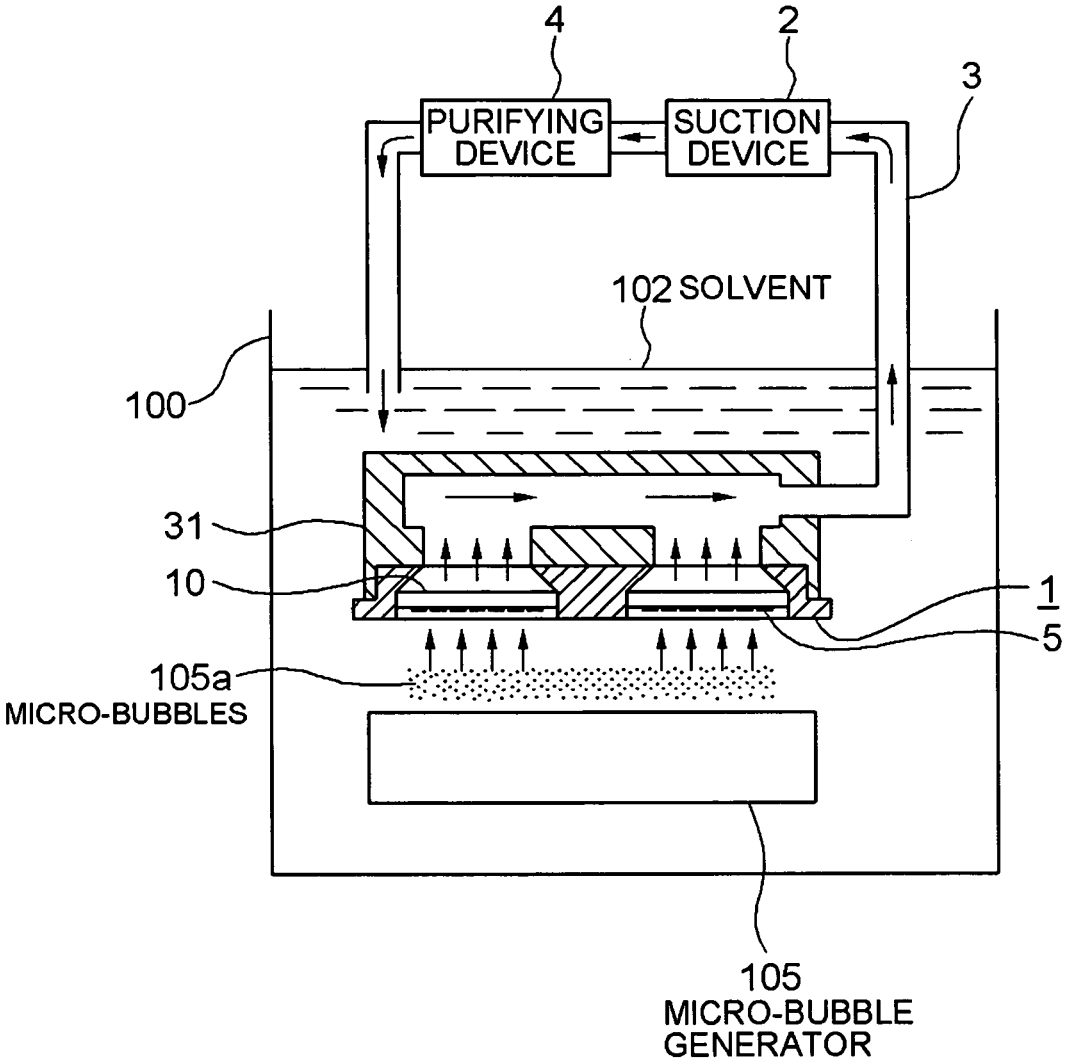
FIG. 12 is a schematic diagram for showing the structure of a washing apparatus according to a third embodiment.

A third embodiment of the present invention will be described by referring to FIG. 12. FIG. 12 is a schematic diagram for showing the structure of the washing apparatus of this embodiment.

(Structure)

The washing apparatus of this embodiment uses a micro-bubble generator 105 (micro-bubble washing device) as a washing device, which washes the wash-target 5 by micro-bubbles 105*a* generated by the micro-bubble generator 105. The structure of the washing apparatus according to this embodiment will be described in detail hereinafter.

As shown in FIG. 12, in the washing apparatus of this embodiment, the wash-target holing apparatuses 1, 2, i.e. the wash-target holder 1, is soaked into the wash tank 100 in a reversed direction of the above-described direction. In other words, the wash-target holder 1 is placed so that the held wash-target 5 faces downwards, and it is supported within the wash tank 100 by a supporting mechanism, not shown. The micro-bubble generator 105 is disposed beneath the wash-target holder 1 for generating the micro-bubbles 105*a*. The micro-bubble generator 105 may be placed outside the wash tank 100, and the generated micro-bubbles 105*a* may be guided beneath the wash target 5 within the wash tank 100.

The structure of the micro-bubble generator 105 is known to those skilled in the art. For example, gases are drawn on the primary side of a cavitation pump, which are fed out by a stable mixing ratio through a revolving accelerator that is attached at a pump discharge port, and micro-bubbles are generated by a shear force of a dispersion device provided at the top end of the pipe. The micro-bubbles 105*a* generated thereby are fine bubbles with the cell diameter of some μm to ten-something μm, having a characteristic of floating slowly in the water and floating up to the water surface by adsorbing minute dusts.

(Washing Action)

Next, action of the washing apparatus with above-described structure will be described. First, suction is performed by the air intake device 21 before soaking the wash-target holder 1 into the wash tank 100 for holding it by adsorbing the wash-target 5 to the bottom face side of the tray 10 by the sucking force. At this time, the above-described cover part 17 may be placed over for preventing the fall of the wash-target 5 from the tray 10.

At the same time the wash-target holder 1 is soaked into the solvent 102, it is switched to the suction by the solvent intake device 22 for holding the wash-target holder 1 by adsorbing the wash-target 5 to the bottom face side of the tray 10 through the force of sucking the solvent (see arrows in FIG. 12). At the time of soaking it into the solvent 102, the buoyant force on the wash-target 5 works in the direction for holding the wash-target to the tray 10 more tightly. Thus, it is not necessary to use the above-described cover part 17 for keeping it held.

Then, the micro-bubbles 105*a* are generated by the micro-bubble generator 105 disposed beneath the wash-target holder 1. Thereby, the micro-bubbles 105*a* slowly float in the water and come in contact with the magnetic head slider 5 as the wash-target that is held facing downwards. At this time, the magnetic head slider 5 is held by the above-described wash-target holder 1, so that there is a widely exposed surface and a large amount of micro-bubbles 105*a* come in contact. Since the micro-bubbles 105*a* are fine bubbles, there is a wide area provided to be in contact with dusts and dirt attached on the magnetic head slider 5, and the dusts and dirt are adsorbed and floated onto the water surface by the surface tension. Thereby, washing is performed.

As described above, unlike the ultrasonic washing according to the first embodiment described above, there is no oscillation generated in this embodiment. Thus, the wash-target 5 can be prevented from being rubbed against the tray 10. Further, unlike the brush washing according to the second embodiment described above, it is possible to suppress contact with the brush or rubbing the wash-target 5 against the tray 10. Therefore, washing can be performed by suppressing damages to the wash-target 5 and a further improvement in the cleanness can be achieved.

Further, the micro-bubbles 105*a* are easily absorbed to the solvent 102, which has a characteristic of contracting and fading in the solvent 102. Thus, it is possible to suppress flow of the bubbles in the form of bubbles into the suction device 2 and the purifying device 4, thereby suppressing a bad influence upon the devices.

The ultrasonic oscillator 101 disclosed in the first embodiment may be disposed within the wash tank 100 of the washing apparatus which uses the above-described micro-bubbles 105*a* for generating the ultrasonic oscillation in the solvent 102. By using both the micro-bubble washing and ultrasonic washing in this way, the washing efficiency can be more improved.

Washing using the above-described micro-bubbles 105*a* can be used for washing many types of wash-targets 5. The holding apparatus for holding the wash-target used at that time is not limited to the wash-target holder 1 that holds the wash-target 5 by the above-described suction, but wash-target holders with other structures may be employed.

Fourth Embodiment

Figure 13:
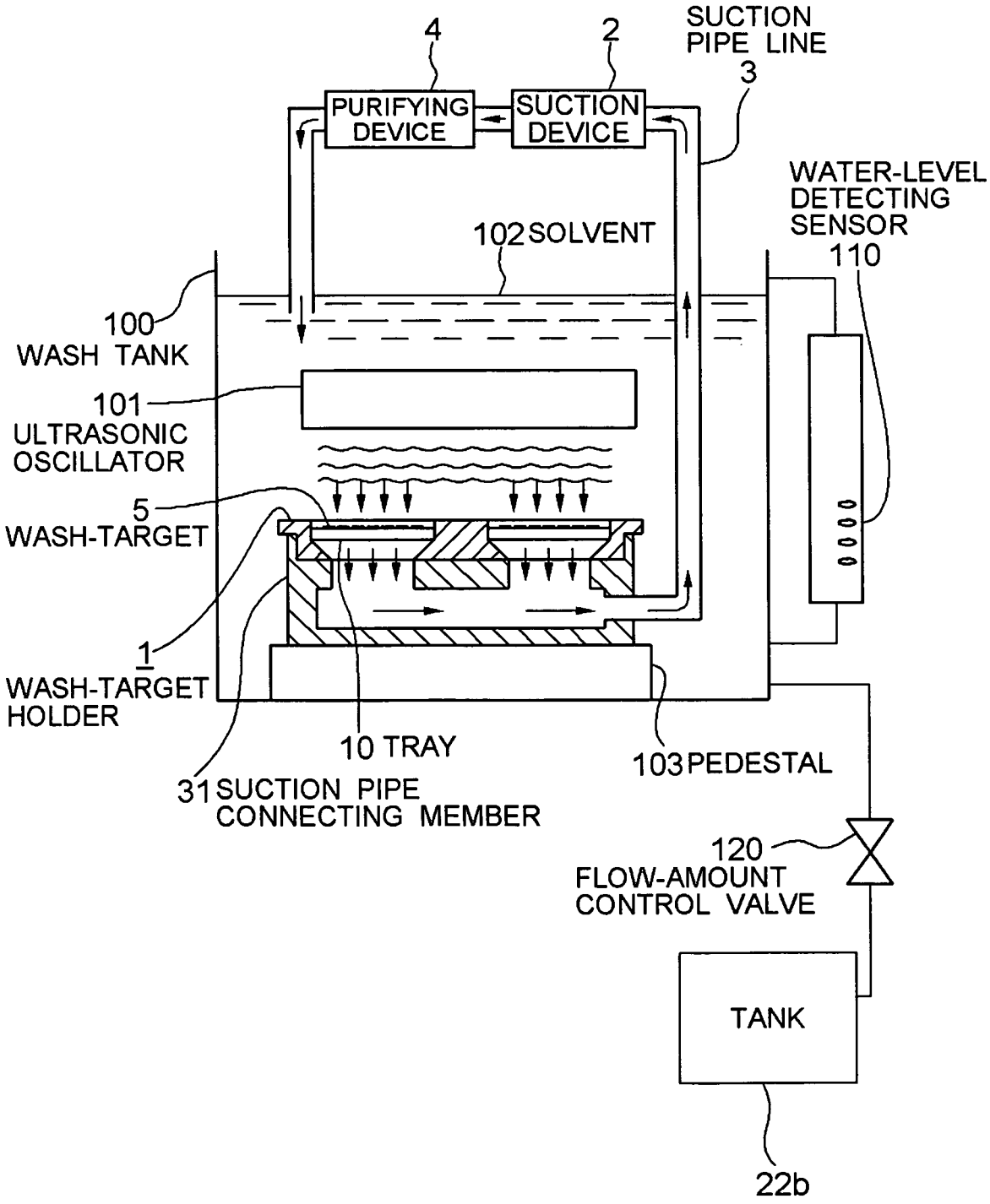
FIG. 13 is a schematic diagram for showing the structure of a washing apparatus according to a fourth embodiment.
Figure 14:
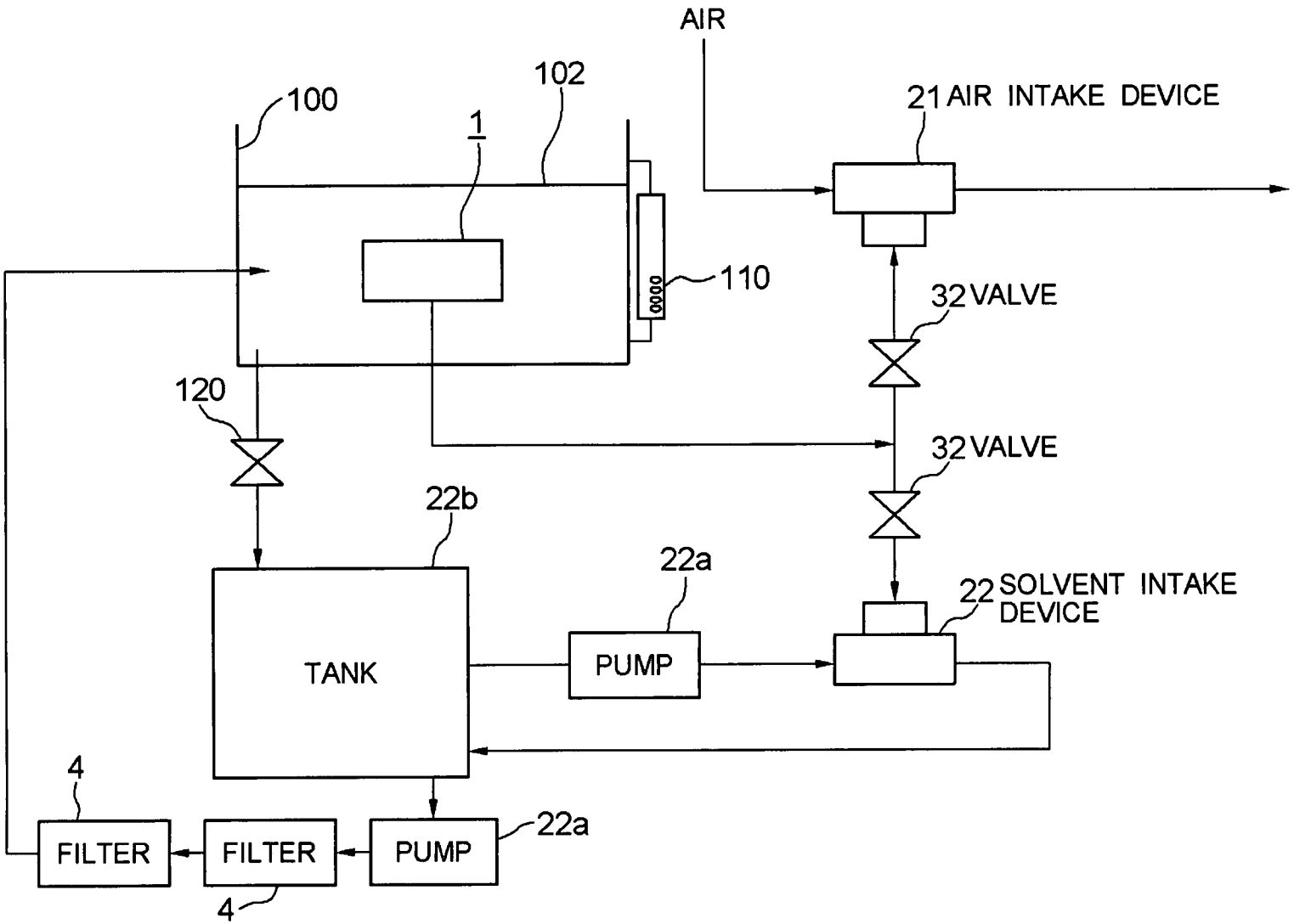
FIG. 14 is a block diagram for showing the structure of the washing apparatus according to the fourth embodiment.

Next, a fourth embodiment of the present invention will be described by referring to FIG. 13 and FIG. 14. FIG. 13 is a schematic diagram for showing the structure of the washing apparatus according to this embodiment. FIG. 14 is a block diagram for showing the structure of the washing apparatus.

(Structure)

The washing apparatus of this embodiment employs almost the same structure as those of the first, second and third embodiments described above. In addition, as shown in FIG. 13 and FIG. 14, the washing apparatus of this embodiment further comprises: a water-level detecting sensor 110 for detecting the liquid-surface height of the solvent 102 within the wash tank 100; and a flow-amount control valve 120 (a solvent water-level adjusting device) for adjusting the water level of the solvent 102 within the wash tank 100. Specifically, the flow-amount control valve 120 is provided on a pipe line that is directed from the wash tank 100 towards the tank 22*b*, thereby allowing control of the amount of the solvent 102 that is drawn from the wash tank 100 and flown into the tank 22*b*.

By controlling open/close of the flow-amount control valve 120 according to the detection value of the water-level detecting sensor 110, the water-surface position of the solvent 102 within the wash tank 100 can be controlled. In other words, by reducing the drawing amount of the solvent 102 and increasing supply of the solvent 102 from the tank 22*b*, the water level can be increased thus providing an immersion state of the wash-target 5 held to the wash-target holder 1. Inversely, by increasing the drawing amount of the solvent 102, the water-level within the wash tank 100 can be lowered thus providing a non-immersion state of the wash-target holder 1. The structure for changing the water level of the solvent (solvent amount) is not limited to the one described above. It may be formed with a pump that simply takes in and out the solvent 102 from the wash tank 100.

(Washing Action)

Next, washing action of the above-described washing apparatus according to the embodiment will be described. The washing action of this embodiment is almost similar to the cases of other embodiments described above, so that only the distinctive part will be described in detail.

First, action for holding a wash-target to the wash-target holder 1 (the wash-target holding step) is the same as the above described action. Thus, the detail thereof will be omitted.

Then, the wash-target holder 1 on which the magnetic head slider 5 is disposed is soaked into the solvent 102 in the wash tank 100 (the soaking step). In this step of this embodiment, first, the wash-target holder 1 is placed at a prescribed position within the wash tank 100. If the wash-target holder 1 is fixedly mounted within the wash tank 100 in advance, it may be left as it is. Then, by closing the flow-amount control valve 120 and supplying the solvent 102 into the wash tank 100 from the tank 22*b* until the water level of the solvent 102 within the wash tank 100 becomes higher than the position of the wash-target 5 held to the wash-target holder 1. Thereby, the wash-target holder 1 can be soaked into the solvent 102. At this time, the air suction is switched to the liquid suction in accordance with the detected value by the water-level detecting sensor 110. That is, by switching the way of suction at the exact timing where the wash-target holder 1 (wash-target 5) is being soaked, a more appropriate suction state can be secured. Thereby, stable holding and washing of the magnetic head slider 5 can be achieved.

Subsequently, the washing action proceeds to the washing step where the washing similar to those of the above-described first, second and third embodiments is performed. After the washing, the wash-target is taken out from the solvent 102. At this stage of this embodiment, the immersion state of the wash-target in the solvent is released by changing the water level of the solvent 102 within the wash tank. Specifically, the flow-amount control valve 120 is opened for increasing the drawing amount of the solvent 102 from the wash tank 100 so as to lower the water-level position within the wash tank 100, thereby providing the state as if the wash-target holder 1 is taken out from the solvent 102. As a result, the solvent 102 can be eliminated from the surroundings of the magnetic head slider 5 as the wash-target.

As described above, the embodiment is capable of providing the immersion state or the state where the wash-target is released from the immersion state by changing the water level of the solvent 102 while fixing the position of the wash-target holder 1. Therefore, a driving device or the like for bringing the wash-target holder 1 in and out of the wash tank 100 becomes unnecessary, thereby allowing simplification of the structure. Moreover, in the case where the wash-target holder 1 is placed into the solvent 102, there may cause separation of the wash-target 5 due to the surface tension. The embodiment can suppress such inconvenience effectively, thereby allowing the stable washing to be performed.

Fifth Embodiment

In the above, there has been described by referring to the case where the magnetic head slider 5 is considered as the wash-target. However, the wash-targets may be other electronic components or fine components. In that case, the part or the surface which requires washing of higher precision may be placed by facing towards the opposite side but not facing the tray 10. Further, as described in the second embodiment, it is preferable to use the tray 10 in which each of the protrusions 12 and 13 is arranged in such a manner that the protrusions 12 and 13 do not come in contact with the part which specifically requires washing of high precision.

The present invention can be utilized as a washing apparatus which can achieve washing with high cleanness when washing electronic components such as magnetic head sliders. Therefore, it has the industrial applicability.

What is claimed is:

1. A wash-target holder to be soaked into a solvent within a wash tank while holding at least one wash-target, comprising a tray formed with a plate-type member, having a wash-target placing face for placing said wash-target, wherein a suction hole is provided at a wash-target placing area of said wash-target placing face of said tray, which is opened through said tray for sucking said wash-target from an opposite side of said wash-target placing area, and said suction hole is formed at a placing position of the wash-target in a size smaller than said placing area of the wash-target and thereby said suction hole is covered by said wash-target placed on the tray, and a surrounding member, comprising a plurality of protrusions, formed around said wash-target, standing up on the wash-target placing face of said tray, wherein said plurality of protrusions are arranged at prescribed intervals in a plurality of rows of protrusions to enable said wash-target to be provided between respective said protrusions.

2. The wash-target holder according to claim 1, wherein an opening provided to said surrounding member is arranged between respective said protrusions for flowing in and out a solvent around said wash target within said wash tank.

3. The wash-target holder according to claim 2, wherein:

said wash-target is a magnetic head slider having a magnetic head element part; and said opening is formed at a position adjacent to said magnetic head element part of said magnetic head slider that is placed on said tray.

4. The wash-target holder according to claim 1, wherein a through-hole opened through said tray is formed at a position other than said wash-target placing area of said tray.

5. The wash-target holder according to claim 1, comprising a separation-restricting member for restricting separation and falling of said wash-target from said tray, which is present during soaking said wash-target holder into said solvent.

6. The wash-target holder according to claim 1, comprising a plurality of said suction holes formed on said tray and a supporting member for supporting said tray from an opposite-side face of a wash-target placing face, wherein a suction port is provided to said supporting member for supplying a sucking force to said plurality of suction holes formed on said tray from said supporting member side.

7. The wash-target holder according to claim 6, wherein said suction port corresponds with a shape or size of said tray.

8. A wash-target holding apparatus, comprising said wash-target holder according to claim 1 and a sucking device for performing suction from said suction hole provided on said tray that constitutes said wash-target holder.

9. A wash-target holding apparatus, comprising said wash-target holder according to claim 6 and a sucking device for performing suction from said suction port provided on said supporting member that constitutes said wash-target holder.

10. The wash-target holding apparatus according to claim 8, comprising a circulating device for returning a solvent in said wash tank drawn by said sucking device to said wash tank.

11. The wash-target holding apparatus according to claim 10, wherein said circulating device comprises a purifying device for purifying said solvent.

12. The wash-target holding apparatus according to claim 8, wherein:

said sucking device comprises a gas intake device for sucking a gas and a liquid intake device that is capable of sucking a liquid; and a switching device is provided for switching said gas intake device and said liquid intake device in accordance with an immersion state of said wash-target holder in said wash tank.

13. The wash-target holding apparatus according to claim 12, wherein said switching device switches to said gas intake device for performing suction when said wash-target holder is not soaked in said solvent and to said liquid intake device for performing suction when said wash-target holder is soaked in said solvent.

14. A washing apparatus, comprising:

a wash-target holder having a tray formed with a plate-type member, having a wash-target placing face for placing a wash-target, wherein a suction hole is provided at a wash-target placing area of said wash-target placing face of said tray, which is opened through said tray for sucking said wash-target from an opposite side of said wash-target placing area;

said suction hole is formed at a placing position of the wash-target in a size smaller than said placing area of the wash-target and thereby said suction hole is covered by said wash-target placed on the tray, a surrounding member, comprising a plurality of protrusions, formed around said wash-target, standing up on the wash-target placing face of said tray;

wherein said plurality of protrusions are arranged at prescribed intervals in a plurality of rows of protrusions to enable said wash-target to be provided between respective said protrusions;

a sucking device for performing suction from said suction hole provided on said tray;

a wash tank in which a solvent for washing said wash-target is filled and said wash-target holder that holds at least one wash-target by suction of said sucking device is soaked; and a washing device for washing said wash-target within said wash tank.

15. The washing apparatus according to claim 14, comprising a circulating device for returning said solvent within said wash tank drawn by said sucking device to said wash tank.

16. The washing apparatus according to claim 15, wherein said circulating device comprises a purifying device for purifying said solvent.

17. The washing apparatus according to claim 14, wherein:

said sucking device comprises a gas intake device for sucking a gas and a liquid intake device that is capable of sucking a liquid; and a switching device is provided for switching said gas intake device and said liquid intake device in accordance with an immersion state of said wash-target holder in said wash tank.

18. The washing apparatus according to claim 17, wherein said switching device switches to said gas intake device for performing suction when said wash-target holder is not soaked in said wash tank and to said liquid intake device for performing suction when said wash-target holder is soaked in said wash tank.

19. The washing apparatus according to claim 14, comprising a solvent level adjusting device for changing a level of said solvent within said wash tank in order to alter an immersion state of said wash-target holder in said wash tank.

20. A washing apparatus, comprising:

said wash-target holding apparatus according to claim 8 for holding at least one wash-target;

a wash tank in which a solvent for washing said wash-target is filled and said wash-target holder that constitutes said wash-target holding apparatus is soaked; and a washing device for washing said wash-target within said wash tank.

21. The washing apparatus according to claim 20, wherein said washing device is an ultrasonic washing device, a micro-bubble washing device, or a brush washing device.

* * * * *